US009518580B2

(12) United States Patent
Harashima

(10) Patent No.: US 9,518,580 B2
(45) Date of Patent: Dec. 13, 2016

(54) SCROLL TYPE FLUID MACHINE

(71) Applicant: Hitachi Industrial Equipment Systems Co., Ltd., Chiyoda-ku, Tokyo (JP)

(72) Inventor: Toshikazu Harashima, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 82 days.

(21) Appl. No.: 14/328,298

(22) Filed: Jul. 10, 2014

(65) Prior Publication Data

US 2015/0152863 A1 Jun. 4, 2015

(30) Foreign Application Priority Data

Dec. 4, 2013 (JP) ..... 2013-250704

(51) Int. Cl.

| | |
|---|---|
| ***F01C 1/02*** | (2006.01) |
| ***F01C 1/063*** | (2006.01) |
| ***F03C 2/02*** | (2006.01) |
| ***F03C 4/00*** | (2006.01) |
| ***F04C 2/02*** | (2006.01) |
| ***F04C 2/063*** | (2006.01) |

(Continued)

(52) U.S. Cl.

CPC ..... *F04C 2/025* (2013.01); *F01C 1/0215* (2013.01); *F01C 1/0246* (2013.01); *F04C 15/0096* (2013.01); *F04C 18/0215* (2013.01); *F04C 18/0269* (2013.01); *F04C 18/0284* (2013.01)

(58) Field of Classification Search

CPC . F01C 1/0215; F04C 15/0096; F04C 18/0215; F04C 18/0269; F04C 18/0284

USPC ..... 418/101, 55.1, 55.2, 55.5

See application file for complete search history.

(56) References Cited

U.S. PATENT DOCUMENTS 4,773,835 A * 9/1988 Machida ..... F04C 18/0269 418/150

5,873,711 A 2/1999 Lifson (Continued)

FOREIGN PATENT DOCUMENTS

JP 8-4669 A 1/1996

JP 11-257259 A 9/1999

(Continued)

OTHER PUBLICATIONS

Japanese Patent Publication 5-141379 to Kokai Sep. 2003.*

(Continued)

*Primary Examiner* — Kenneth Bomberg

*Assistant Examiner* — Deming Wan

(74) *Attorney, Agent, or Firm* — Crowell & Moring LLP

(57) ABSTRACT

A scroll type fluid machine for improving compression efficiency while preventing contact between wrap sections of opposed scrolls, includes a first scroll member provided with a wrap section of a spiral shape on an end plate, a second scroll member disposed at a position opposed to the first scroll member and provided with a wrap section of a spiral shape on an end plate, cooling fins arranged on a back side surface of the end plate of at least one of the first scroll member and the second scroll member, and projected sections arranged on the wrap section of at least one of the first scroll member and the second scroll member, in which a difference of thicknesses in the radial direction of the wrap section at a distal end and a base end of the projected sections is changed depending on a position in a peripheral direction.

16 Claims, 5 Drawing Sheets

(51) Int. Cl.
*F04C 18/02* (2006.01)
*F04C 15/00* (2006.01)

(56) References Cited

U.S. PATENT DOCUMENTS

| | | | | |
|---|---|---|---|---|
| 2004/0062671 | A1* | 4/2004 | Suefuji | F04C 27/002 418/55.2 |
| 2008/0159894 | A1* | 7/2008 | Kanemoto | F01C 1/0215 418/55.2 |
| 2010/0284845 | A1 | 11/2010 | Taniguchi et al. | |
| 2012/0189480 | A1* | 7/2012 | Yamazaki | F04C 18/0253 418/55.2 |

FOREIGN PATENT DOCUMENTS

| | | | |
|---|---|---|---|
| JP | 2004-138056 | A | 5/2004 |
| JP | 2006-17013 | A | 1/2006 |
| JP | 2010-101330 | A | 5/2010 |
| JP | 2012-57635 | A | 3/2012 |

OTHER PUBLICATIONS

European Search Report (14002341.7) dated Sep. 30, 2014 (eight (8) pages).
Korean Office Action issued in counterpart Korean Application No. 10-2014-0065658 dated Sep. 14, 2015 with partial English-language translation (five (5) pages).

* cited by examiner

SCROLL TYPE FLUID MACHINE

INCORPORATION BY REFERENCE

The present application claims priority from Japanese application JP2013-250704, filed on Dec. 4, 2013, the content of which is hereby incorporated by reference into this application.

BACKGROUND OF THE INVENTION

1. Field of the Invention

The present invention relates to a scroll type fluid machine.

2. Description of the Related Art

As related art in the field of invention of the present invention, JP-A-2004-138056 and JP-A-2006-017013 can be cited.

In JP-A-2004-138056, a scroll type fluid machine is described in which plural numbers of projections are arranged on a peripheral surface of a wrap section of at least one of scrolls.

In JP-A-2006-017013, a scroll type fluid machine is described in which thin sections are formed in a predetermined angle range on the inner peripheral surface or the outer peripheral surface of the wrap section of the fixed scroll.

In the scroll type fluid machine of JP-A-2004-138056, the plural numbers of projections are provided so as to enhance sealing performance in a compressing period, and thus, compression efficiency is improved.

Here, in the scroll type fluid machine, the wrap section formed in the scroll is thermally deformed by compression heat at the time of operation. Deformation of the wrap section by thermal deformation is not uniform depending on the position in the peripheral direction due to the effect of the cooling fins and the like provided on the back side surface of the wrap section, the gap between the wrap sections of the opposed scrolls is large in some portion, and is small in other portion.

Therefore, for example, as described in JP-A-2006-017013, by forming the thin sections for the portions where the gap of the wrap sections of the opposed scrolls became small due to the thermal deformation, the compression efficiency was improved while preventing contact of the wrap sections to each other at the time of operation.

However, when, in view of the effect of the thermal expansion at the time of operation, the wrap sections were kept from coming in contact with each other, the gap between the wrap sections of the opposed scrolls became large beyond necessity. In particular, leakage of the compressed fluid at the time of the start of operation increased, the sealing performance of the compression chamber could not be enhanced, and the compression efficiency could not be improved.

SUMMARY OF THE INVENTION

In view of the problems described above, the object of the present invention is to provide a scroll type fluid machine in which the compression efficiency is improved while avoiding contact of the wrap sections of the scrolls opposed to each other.

In order to solve the problems described above, the present invention provides "a scroll type fluid machine including a first scroll member provided with a wrap section of a spiral shape on an end plate, a second scroll member disposed at a position opposed to the first scroll member and provided with a wrap section of a spiral shape on an end plate, cooling fins arranged on a back side surface of the end plate of at least one of the first scroll member and the second scroll member, and projected sections arranged on the wrap section of at least one of the first scroll member and the second scroll member, in which a difference of thickness in the radial direction of the wrap section at a distal end and a base end of the projected sections is changed depending on the position in the peripheral direction".

According to the present invention, a scroll type fluid machine can be provided in which the compression efficiency is improved while avoiding contact of the wrap sections of the scrolls opposed to each other.

Other objects, features and advantages of the invention will become apparent from the following description of the embodiments of the invention taken in conjunction with the accompanying drawings.

DETAILED DESCRIPTION OF THE INVENTION

Hereinafter, as an example of a scroll type fluid machine, a scroll type compressor according to Embodiments 1-4 of the present invention will be described with reference to FIGS. 1-7.

[Embodiment 1]

Hereinafter, Embodiment 1 according to the present invention will be described in detail with reference to FIGS. 1-5.

Figure 1:
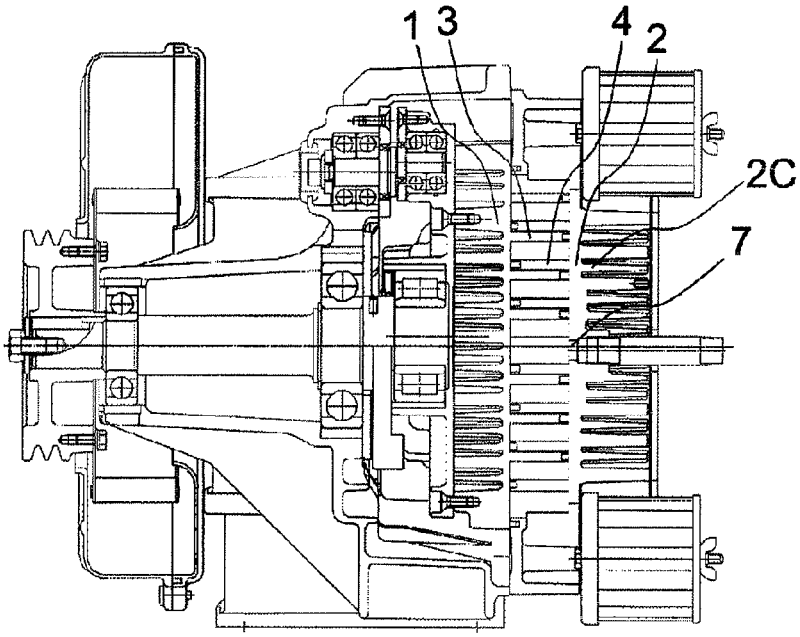
FIG. 1 is a cross-sectional view of the entirety of a scroll type fluid machine according to Embodiment 1 of the present invention.

An overall structure of a scroll type compressor according to the present embodiment will be described using a drawing in FIG. 1. The scroll type compressor according to the present embodiment includes a orbiting scroll 1 formed with a wrap section 3 of a spiral shape on an end plate 1A, and a fixed scroll 2 arranged at a position opposed to the orbiting scroll 1 and formed with a wrap section 4 of a spiral shape on an end plate 2A. On the back surface of (at least one of) the orbiting scroll 1 and the fixed scroll 2, cooling fins 1C, 2C are arranged respectively.

Figure 2:
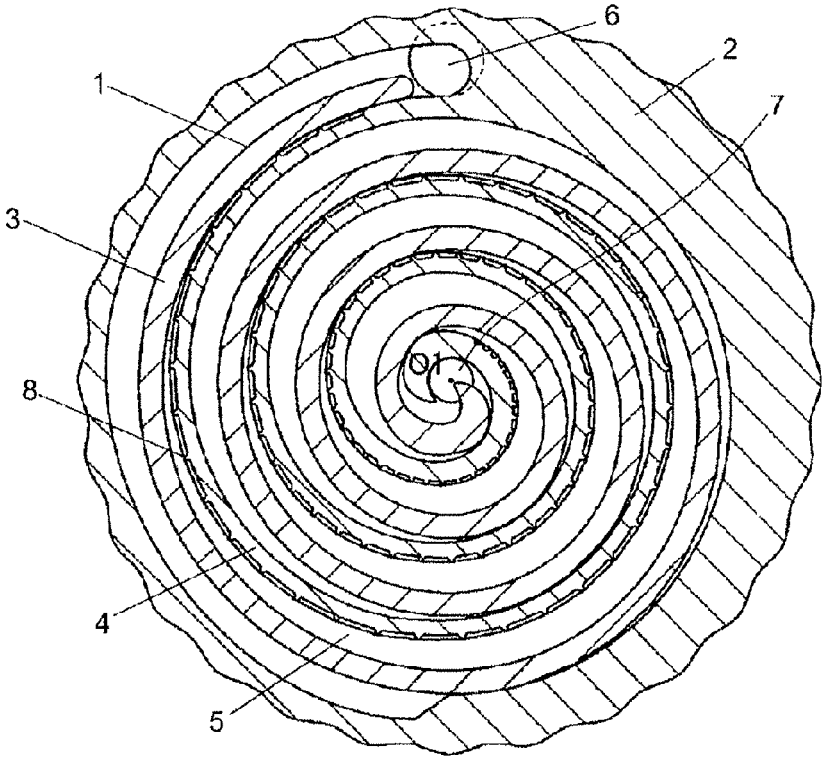
FIG. 2 is a cross-sectional view of wrap sections in the scroll type fluid machine according to Embodiment 1 of the present invention.

With reference to FIG. 2, motion of the scroll type compressor according to the present embodiment will be described. By orbiting motion of the orbiting scroll 1, a compression chamber 5 defined between the wrap section 4 of the fixed scroll 2 and the wrap section 3 of the orbiting scroll 1 is reduced continuously. Thus, while compressing the air sucked from a suction port 6 sequentially, respective compression chambers discharge the compressed air from a discharge port 7 toward an external air tank (not shown).

Figure 3A:
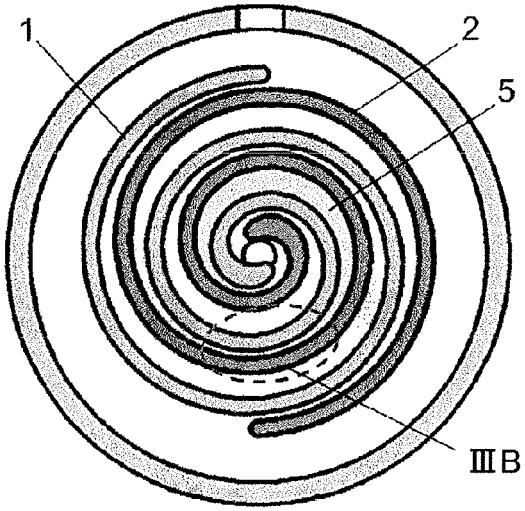
FIG. 3A is a cross-sectional view showing wrap sections of a scroll type fluid machine.
Figure 3B:
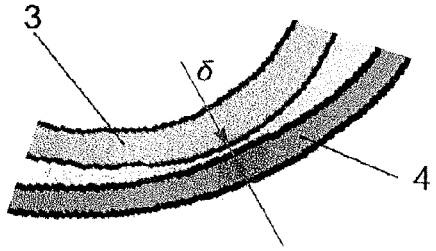
FIG. 3B is an enlarged view of IIIB part in FIG. 3A.

Here, in general, in the scroll type compressor, a gap δ in the radial direction formed between the wrap sections 3, 4 of the orbiting scroll 1 and the fixed scroll 2 (referred to as a wrap gap) is made as narrow as possible as shown in FIGS. 3A, 3B, so as to suppress leakage of the compressed air from respective compression chambers, and thereby, intending to improve efficiency and the like as an air compressor. On the other hand, if the wrap gap δ is narrowed, when the wrap is thermally deformed due to the effect of the compression heat and the like, the wrap sections 3, 4 may possibly come into contact with each other. Therefore, the wrap gap δ is set so that the wrap sections 3, 4 do not come into contact with each other and the compression efficiency is enhanced. However, because the wrap sections 3, 4 are deformed due to the compression heat with the operation of the scroll type compressor, the optimum wrap gap δ changes depending on the time after the start of operation. Therefore, when prevention of contact of the wrap sections 3, 4 was considered as a matter of the highest priority, it was hard to improve the compression efficiency.

Figure 4A:
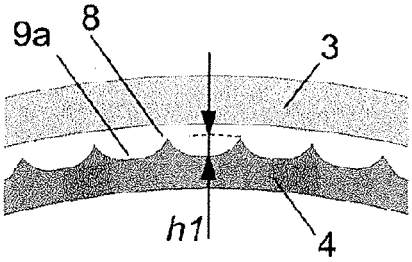
FIGS. 4A, 4B are enlarged views of a condition between the wrap sections of the scroll type fluid machine according to Embodiment 1 of the present invention.
Figure 4B:
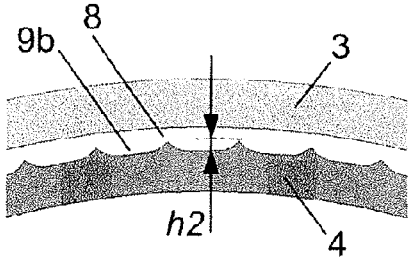

Therefore, in the present embodiment, projected sections 8 are arranged on the side surface of the wrap section as shown in FIGS. 4A, 4B, and, even when the wrap sections contact with each other, only the distal ends of the projected sections 8 contact, and thereby, it prevents all of the side surfaces of the wrap sections from contacting (biting). Thus, the leakage amount of the compressed air can be reduced, and the compression efficiency can be improved.

On the other hand, when the gap between the distal end of the projected sections 8 and the wrap section 3, 4 of the scroll opposed to the distal end is narrowed excessively, not only the projected sections 8 but also the entire wrap sections 3, 4 contact with each other. Therefore, it is necessary to make the gap have a certain amount between the distal end of the projected sections 8 and the wrap section 3, 4 of the scroll opposed to the distal end. Here, due to deformation by the compression heat with the operation of the scroll type compressor, with respect to the gap between the distal end of the projected sections 8 and the wrap section 3, 4 of the scroll opposed to the distal end also, the optimum gap changes depending on the time after the start of operation. It was hard to improve the compression efficiency on the premise that the entire wrap sections 3, 4 did not contact with each other even when only the gap between the distal end of the projected sections 8 and the wrap section 3, 4 of the scroll opposed to the distal end was considered.

Therefore, in the present embodiment, as shown in FIGS. 4A, 4B, not the gap between the distal end of the projected sections 8 and the wrap section 3, 4 of the scroll opposed to the distal end, but the difference h between the thicknesses in the radial direction of the wrap section at the distal end of the projected sections 8 and a base end 9 (9*a*, 9*b*) thereof is changed depending on the position in the peripheral direction. That is, the difference of the gaps between the projected section and the wrap section 3, 4 of the opposed scroll at the distal end of the projected section 8 and the base end 9 thereof is changed depending on the position in the peripheral direction.

At this time, the difference h2 of the thicknesses in the radial direction of the wrap section 3, 4 at the distal end of the projected section 8 and the base end 9*b*, in the portion where the wrap gap becomes larger due to thermal deformation in FIG. 4B, is set smaller than the difference h1 of the thicknesses in the radial direction of the wrap section 3, 4 at the distal end of the projected section 8 and the base end 9*a*, in the portion where the wrap gap becomes smaller due to thermal deformation in FIG. 4A (h1>h2). Similarly, the difference of the gaps between the projected section and the wrap section 3, 4 of the opposed scroll at the distal end of the projected sections 8 and the base end 9*b* thereof, in the portion where the wrap gap becomes larger due to thermal deformation in FIG. 4B is also set smaller than the difference of the gaps between the projected section and the wrap section 3, 4 of the opposed scroll at the distal end of the projected sections 8 and the base end 9*a* thereof, in the portion where the wrap gap becomes smaller due to thermal deformation in FIG. 4A.

Thus, with respect to the portion where the wrap gap becomes smaller due to thermal deformation, by increasing the difference of the thicknesses in the radial direction of the wrap section at the distal end of the projected section 8 and the base end 9*b* thereof and the difference of the gaps between the projected section and the wrap section 3, 4 of the opposed scroll at the distal end of the projected section 8 and the base end 9*b* thereof, even when the distal end of the projected section 8 is brought closer to the wrap section 3, 4 of the opposed scroll, it can prevent the entire wrap sections from making contact with each other. Thus, the distal end of the projected section 8 can be brought closer to the wrap section 3, 4 of the opposed scroll, and the leakage amount of the compressed air can be reduced, and thereby, improving the compression efficiency. On the other hand, with respect to the portion where the wrap gap becomes larger due to thermal deformation, by reducing the difference of the thicknesses in the radial direction of the wrap section at the distal end of the projected section 8 and the base end 9*a*, leakage at the base end 9*a* of the projected section 8 can be reduced, and the compression efficiency can be improved further.

Figure 5:
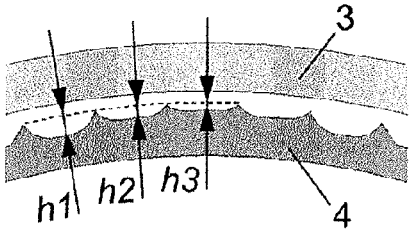
FIG. 5 is an enlarged view of another condition between the wrap sections of the scroll type fluid machine according to Embodiment 1 of the present invention.

Also, as shown in FIG. 5, by changing the difference h of the thicknesses in the radial direction of the wrap section at the distal end of the projected section 8 and the base end 9 in multiple stages depending on the wrap gap generated by thermal deformation (h1>h2>h3), leakage on the labyrinth base end side can be further reduced.

From the above, according to the present embodiment, by setting the difference of the thicknesses in the radial direction of the wrap section at the distal end of the projected sections 8 and the base end 9 and the difference of the gaps between the projected section and the wrap section 3, 4 of the opposed scroll at the distal end of the projected sections 8 and the base end 9 in a portion where the wrap gap becomes larger due to thermal deformation smaller than those in a portion where the wrap gap becomes smaller due to thermal deformation, the leakage amount of the compressed air can be reduced and the compression efficiency can be improved while preventing the entire wrap sections from making contact with each other.

[Embodiment 2]

Figure 6:
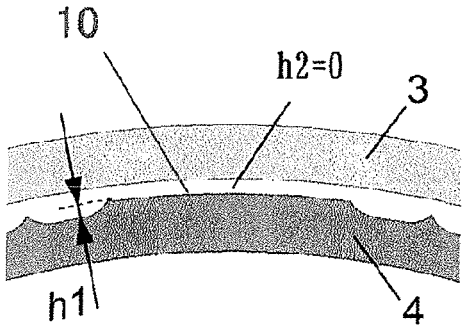
FIG. 6 is an enlarged view of a condition between wrap sections of a scroll type fluid machine according to Embodiment 2 of the present invention.

Embodiment 2 according to the present invention will be described with reference to FIG. 6. With respect to the configuration same to that of Embodiment 1, same reference sign will be given and description thereof will be omitted.

In the present embodiment, any projected sections are not arranged on side surface 10 of the wrap section 3, 4 in the portion where the wrap gap becomes larger due to thermal deformation, and the projected sections are arranged only in the portion where the wrap gap becomes smaller due to thermal deformation. That is, the difference h2 of the thicknesses in the radial direction of the wrap section 3, 4 at the distal end of the projected section 8 and the base end 9 in Embodiment 1 is made zero in the portion where the wrap gap becomes larger due to the thermal deformation. Similarly, the difference of the gaps between the projected section and the wrap section 3, 4 of the opposed scroll at the distal end of the projected section 8 and the base end 9 thereof is also made zero in the portion where the wrap gap became larger due to thermal deformation. Thus, as compared with Embodiment 1, with respect to the portion where the wrap gap becomes larger due to thermal deformation, leakage at the base end 9 of the projected section 8 can be reduced, and the compression efficiency can be improved further.

[Embodiment 3]

Figure 7A:
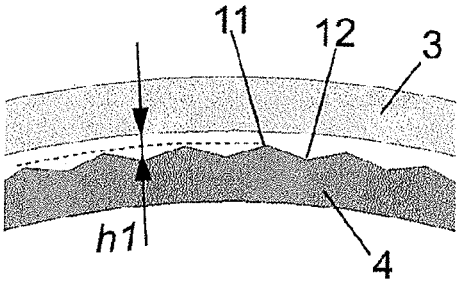
FIGS. 7A, 7B are enlarged views of a condition between wrap sections of a scroll type fluid machine according to Embodiment 3 of the present invention.
Figure 7B:
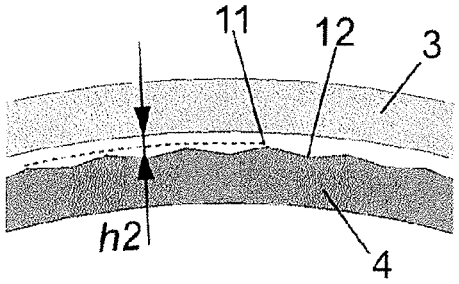

Embodiment 3 according to the present invention will be described with reference to FIGS. 7A, 7B. With respect to the configuration same to those of Embodiments 1, 2, same reference sign will be given and description thereof will be omitted.

In the present embodiment, a plurality of the projected sections 8 arranged on the side surface of the wrap section 3, 4 are connected so that the side surface of the wrap section 3, 4 has a polygon-like shape.

The projected sections 8 (polygon-like projected sections 11) has a dimension so that the difference h of the thicknesses in the radial direction of the wrap section at the distal end of the projected section and a base end 12 is changed depending on the position in the peripheral direction. That is, the difference of the gaps between the projected section and the wrap section 3, 4 of the opposed scroll at the distal end of the projected section and the base end 12 is changed depending on the position in the peripheral direction. More specifically, the difference h2 of the thicknesses in the radial direction of the wrap section at the distal end of the polygon-like projected section 11 and the base end 12, in the portion where the wrap gap becomes larger due to thermal deformation is set smaller than the difference h1 h2 of the thicknesses in the radial direction of the wrap section at the distal end of the polygon-like projected section 11 and the base end 12 in the portion where the wrap gap becomes smaller due to thermal deformation. Thus, leakage on a side of the polygon-like projected section base end 12 in the portion where the wrap gap is enlarged due to thermal deformation can be reduced.

According to the present embodiment, as compared with Embodiments 1, 2, the wrap sections 3, 4 can be formed with easy working, leakage at the base end 9 of the projected sections 8 can be reduced in the portion where the wrap gap becomes larger due to thermal deformation, and the compression efficiency can be further improved.

[Embodiment 4]

Embodiment 4 according to the present invention will be described with reference to FIGS. 8, 9. With respect to the configuration same to those of Embodiments 1-3, same reference sign will be given and description thereof will be omitted.

In the end plate 2A of the fixed scroll 2, a plurality of cooling fins 2C, 2C, . . . extending respectively in one direction (along a line X-X in FIG. 8) so as to be parallel with each other are arranged on a back side surface thereof, so as to cool the end plate 2A from the back side surface by circulating cooling air along these cooling fins 2C, and to reduce deformation of the wrap section 4 of a spiral shape due to the effect of the compression heat and the like.

Figure 8:
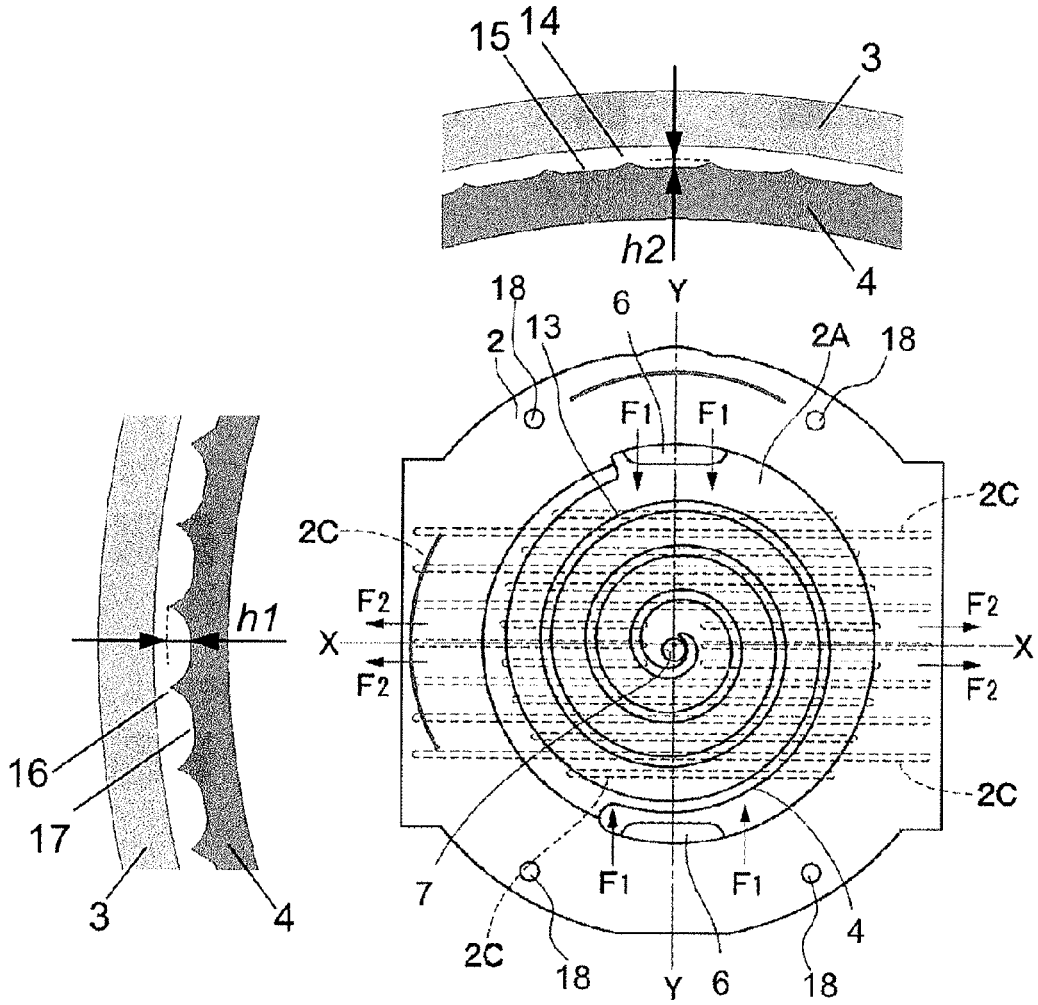
FIG. 8 is a cross-sectional view of wrap sections of a scroll type fluid machine according to Embodiment 4 of the present invention.

In the fixed scroll 2, since the respective cooling fins 2C arranged on the back side surface of the end plate 2A extend so as to be parallel to each other along the line X-X in FIG. 8, the rigidity of the overall fixed scroll 2 tends to be high in the direction of the line X-X along which the cooling fins 2C extend, and tends to be low in a direction of a line Y-Y perpendicular thereto.

Figure 9:
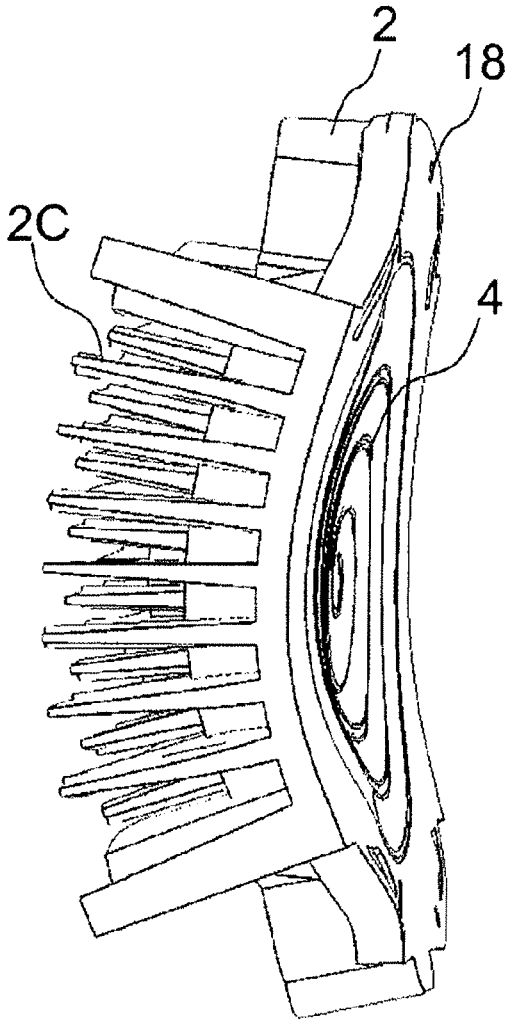
FIG. 9 is a drawing showing deformation of the scroll of the scroll type fluid machine according to Embodiment 4 of the present invention.

In the fixed scroll 2, as shown in FIGS. 8, 9, a flange section 18 is fixed to a casing (not illustrated) that contains the orbiting scroll 1 from the outside. Therefore, the fixed scroll 2 is deformed so as to curve to the back side surface where the cooling fins 2C are formed as shown in FIG. 9 due to the effect of the pressure of the compressed air, compression heat and the like generated inside the compression chamber 5 for example.

Therefore, when the wrap section 4 of the fixed scroll 2 is deformed due to the effect of the pressure of the compressed air, compression heat and the like generated inside the compression chamber 5 for example, the diameter is reduced inward in the radial direction with respect to a direction of the arrows F1, F1 shown in FIG. 8 for example. At this time, the gap between the tip section of the wrap section 4 of the fixed scroll 2 and the root section of the wrap section 3 of the opposed orbiting scroll 1 on the outer side in the radial direction increases.

For the fixed scroll 2 as deformed above, the difference of the thicknesses in the radial direction of the wrap section and the difference of the gaps between the projected section and the wrap section 3, 4 of the opposed scroll at the distal end and the base end of the projected section 8 formed at least one of the outer peripheral surface of the wrap section 4 of the fixed scroll 2 and the inner peripheral surface of the wrap section 3 of the orbiting scroll 1 are set so that the difference between projected sections 14 and base end sections 15 formed within a predetermined angle range (of less than 90 degrees) including a direction (the direction of the arrows F1, F1) perpendicular to the direction along which the cooling fins 2C extend becomes smaller than the difference between projected sections 16 and base end sections 17 formed within a predetermined angle range (of less than 90 degrees) including the direction along which the cooling fins 2C extend (a direction of the arrows F2, F2).

Adversely, in the direction of the arrows F2, F2, the diameter of the end plate 2A of the fixed scroll 2 is expanded. At this time, the gap between the tip section of the wrap section 4 of the fixed scroll 2 and the root section of the wrap section 3 of the opposed orbiting scroll 1 on the inner side in the radial direction increases.

For the fixed scroll 2 as deformed above, the difference of the thicknesses in the radial direction of the wrap portion and the difference of the gaps between the projected section and the wrap section 3, 4 of the opposing scroll at the distal end and the base end of the projected section 8 formed on at least one of the outer peripheral surface of the wrap section 4 of the fixed scroll 2 and the inner peripheral surface of the wrap section 3 of the orbiting scroll 1 are set so that the difference between the projected sections 16 and the base end sections 17 formed within a predetermined angle range (of less than 90 degrees) including the direction along which the cooling fins 2C extend (the direction of the arrows F2, F2) becomes smaller than the difference between the projected sections 14 and the base end sections 15 formed within a predetermined angle range (of less than 90 degrees) including the direction perpendicular to the direction along which the cooling fins 2C extend (the direction of the arrows F1, F1).

According to the present embodiment, after due consideration more precisely beforehand whether the gap between the wrap section 3 of the orbiting scroll 1 and the wrap section 4 of the fixed scroll 2 becomes large or small corresponding to the direction along which the cooling fins 2C extend, the leakage amount of the compressed air can be reduced more while preventing contact of the overall wrap sections, and thereby, further improving the compression efficiency.

Embodiments 1-4 are described exemplifying the case the scroll type fluid machine is used as an air compressor. However, the present invention is not limited to it and can be applied to other scroll type fluid machines including a coolant compressor compressing a coolant, vacuum pump, and the like for example.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A scroll type fluid machine, comprising:

a first scroll member provided with a wrap section of a spiral shape on an end plate;

a second scroll member disposed at a position opposed to said first scroll member and provided with a wrap section of a spiral shape on an end plate;

cooling fins arranged on a back side surface of said end plate of at least one of said first scroll member and said second scroll member; and projected sections arranged on said wrap section of at least one of said first scroll member and said second scroll member, wherein a difference between thicknesses in a radial direction of said wrap section at a distal end of the projected sections and the thickness at a base end of the projected sections is changed depending on a position of the projected section in a peripheral direction of the wrap section.

2. The scroll type fluid machine according to claim 1, wherein a difference between the thickness at a distal end of a first projected section, where a gap between the first projected section and the opposed scroll member expands at the time of thermal expansion of the first member and the second scroll member, and the thickness at a base end of the first projected section is smaller than a difference between the thickness at a distal end of a second projected section, where a gap between the second projected section and the opposed scroll member shortens at the time of thermal expansion of the first member and the second scroll member, and the thickness at a base end of the second project section.

3. The scroll type fluid machine according to claim 2, wherein, with respect to a difference of thicknesses in the radial direction of the wrap section at the distal end and the base end of the projected sections formed on an outer peripheral surface of the wrap section, that of the projected sections formed within a predetermined angle range including a direction perpendicular to a direction along which the cooling fins extend is smaller than that of the projected sections formed within a predetermined angle range including the direction along which the cooling fins extend.

4. The scroll type fluid machine according to claim 3, wherein any projected sections are not arranged on an outer peripheral surface of the wrap section within a predetermined angle range including a direction perpendicular to a direction along which the cooling fins extend.

5. The scroll type fluid machine according to claim 2, wherein, with respect to a difference of thicknesses in the radial direction of the wrap section at a distal end and a base end of the projected sections formed on an inner peripheral surface of the wrap section, that of the projected sections formed within a predetermined angle range including a direction along which the cooling fins extend is smaller than that of the projected section formed within a predetermined angle range including a direction perpendicular to a direction along which the cooling fins extend.

6. The scroll type fluid machine according to claim 5, wherein any projected sections are not arranged on an inner peripheral surface of the wrap section within a predetermined angle range including a direction along which the cooling fins extend.

7. The scroll type fluid machine according to claim 1, wherein any projected sections are not arranged in a portion where the gap between the projected section and the opposed scroll member is expanded at the time of thermal expansion of the first scroll member and the second scroll member.

8. The scroll type fluid machine according to claim 1, wherein a portion of said wrap section where a gap between the projected section and the opposing scroll member is expanded at the time of thermal expansion of the first scroll member and the second scroll member is formed into a polygon-like shape.

9. A scroll type fluid machine, comprising:

a first scroll member provided with a wrap section of a spiral shape on an end plate;

a second scroll member disposed at a position opposed to the first scroll member and provided with a wrap section of a spiral shape on an end plate;

cooling fins arranged on a back side surface of said end plate of at least one of said first scroll member and said second scroll member; and projected sections arranged on said wrap section of at least one of said first scroll member and said second scroll member, wherein a difference between a gap between the projected section and said opposed scroll member at a distal end of said projected sections and the gap at a base end of said projected sections is changed depending on a position of the projected section in a peripheral direction.

10. The scroll type fluid machine according to claim 9, wherein a difference between the gap at a distal end of a first projected section, where a gap between the first projected section and the opposed scroll member expands at the time of thermal expansion of the first member and the second scroll member, and the gap at a base end of the first projected section is smaller than a difference between the gap at a distal end of a second projected section, where a gap between the second projected section and the opposed scroll member shortens at the time of thermal expansion of the first member and the second scroll member, and the gap at a base end of the second projected section.

11. The scroll type fluid machine according to claim 10, wherein, with respect to a difference of the gaps between the projected section and the opposed scroll member at a distal end and a base end of the projected sections formed on an outer peripheral surface of the wrap section, that of the projected sections formed within a predetermined angle range including a direction perpendicular to a direction along which the cooling fins extend is smaller than that of the projected sections formed within a predetermined angle range including a direction along which the cooling fins extend.

12. The scroll type fluid machine according to claim 11, wherein any projected sections are not arranged on an outer peripheral surface of the wrap section within a predetermined angle range including a direction perpendicular to a direction along which the cooling fins extend.

13. The scroll type fluid machine according to claim 10, wherein, with respect to a difference of the gaps between the projected section and the opposed scroll member at a distal end and a base end of the projected sections formed on an inner peripheral surface of the wrap section, that of the projected sections formed within a predetermined angle range including a direction along which the cooling fins extend is smaller than that of the projected section formed within a predetermined angle range including a direction perpendicular to a direction along which the cooling fins extend.

14. The scroll type fluid machine according to claim 13, wherein any projected sections are not arranged on an inner peripheral surface of the wrap section with respect to a predetermined angle range including a direction along which the cooling fins extend.

15. The scroll type fluid machine according to claim 9, wherein any projecting sections are not arranged in a portion where the gap between the projected section and the opposed scroll member is expanded at the time of thermal expansion of the first scroll member and the second scroll member.

16. The scroll type fluid machine according to claim 9, wherein a portion where the gap between the projected section and the opposed scroll member is expanded at the time of thermal expansion of the first scroll member and the second scroll member is formed into a polygon-like shape.

* * * * *